United States Patent [19]

Weinberg

[11] Patent Number: 4,566,458

[45] Date of Patent: Jan. 28, 1986

[54] THORAX PROTECTOR

[76] Inventor: Marc S. Weinberg, 82 Talbot Way, Seekonk, Mass. 02771

[21] Appl. No.: 553,952

[22] Filed: Nov. 21, 1983

[51] Int. Cl.[4] ..... A41C 3/10; A61F 13/00; A41D 13/00

[52] U.S. Cl. ..... 128/478; 2/1; 128/132 R

[58] Field of Search ..... 2/1, 2; 128/132, 158, 128/425, 463, 479, 481, 456

[56] References Cited

U.S. PATENT DOCUMENTS

| | | | |
|---|---|---|---|
| 577,311 | 2/1897 | McCleary | 128/462 |
| 2,468,841 | 5/1949 | Siegel | 2/51 |
| 2,864,372 | 12/1958 | Buckley | 128/462 |
| 3,162,861 | 12/1968 | Gustafson | 2/2 |
| 3,176,686 | 4/1965 | Barnes | 128/132 |
| 3,478,739 | 11/1969 | Librande | 128/132 |
| 3,521,642 | 7/1970 | Jordan | 128/479 |

*Primary Examiner*—Doris L. Troutman
*Attorney, Agent, or Firm*—Kenyon & Kenyon

[57] ABSTRACT

A thorax protector, designed for optimal protection of the breasts such that forces directed at it are distributed along the lines of support of the rib cage, includes rigid cups and inner liners with anatomically contoured shapes.

12 Claims, 10 Drawing Figures

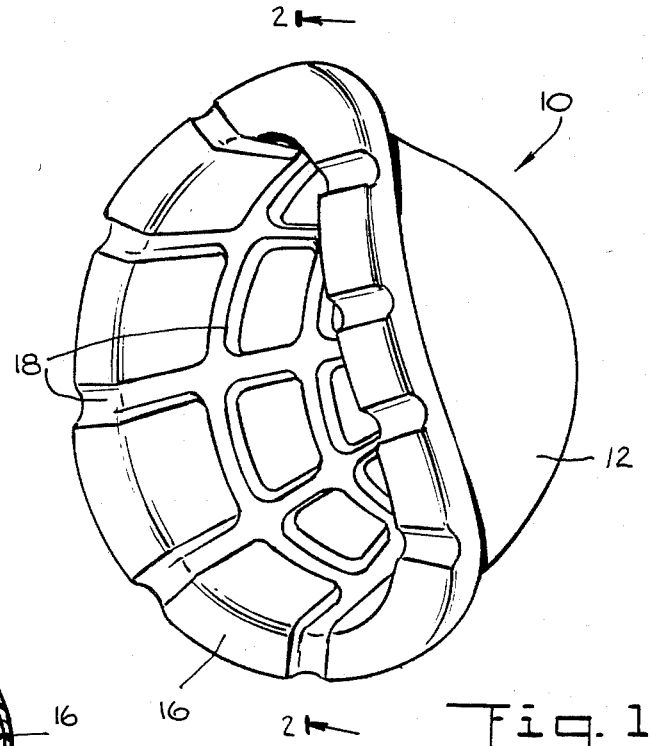
Fig. 1.
Fig. 2.
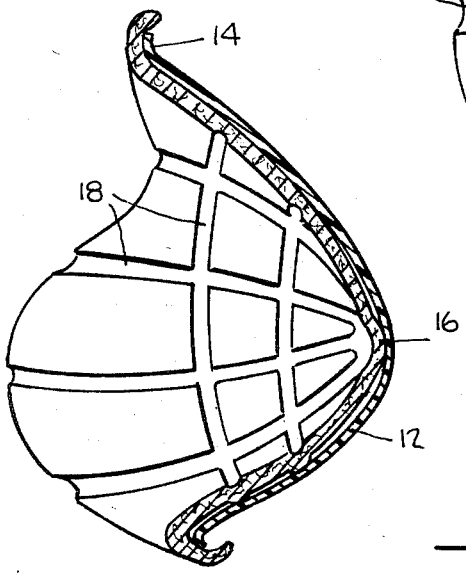
Fig. 3.
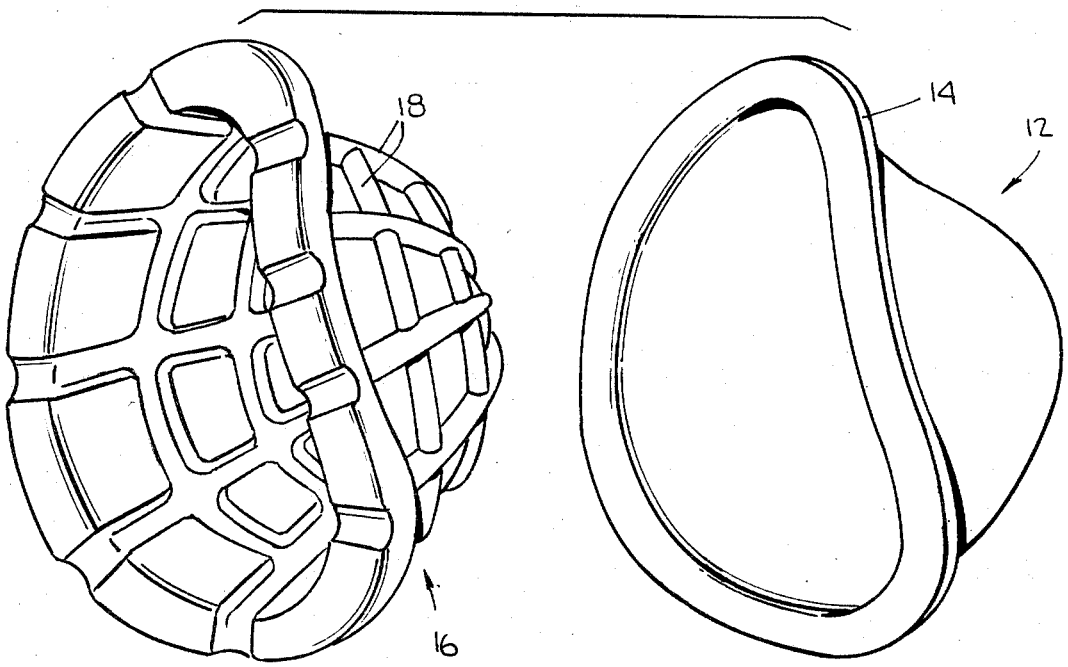

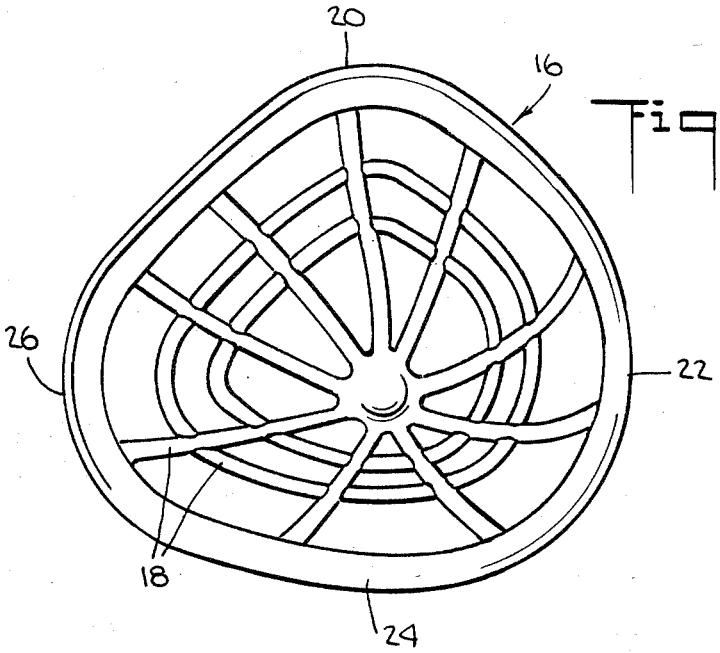
Fig. 4.
Fig. 5.
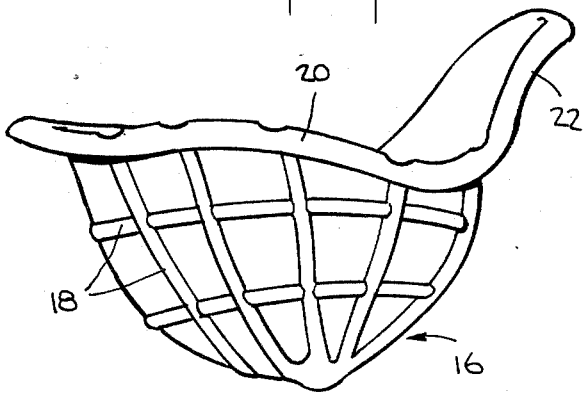
Fig. 6.
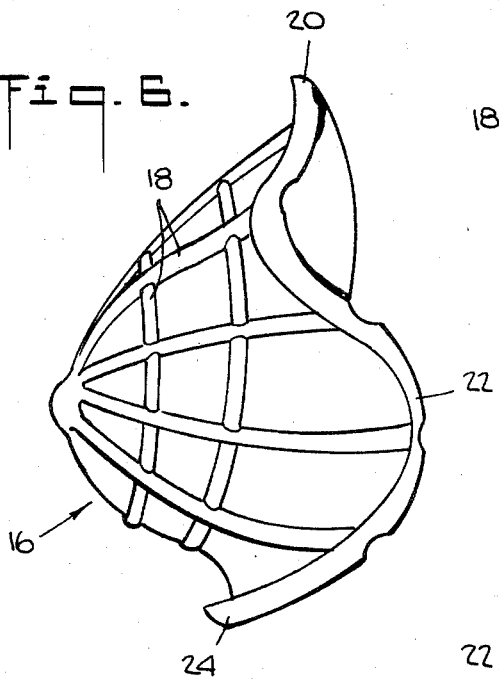
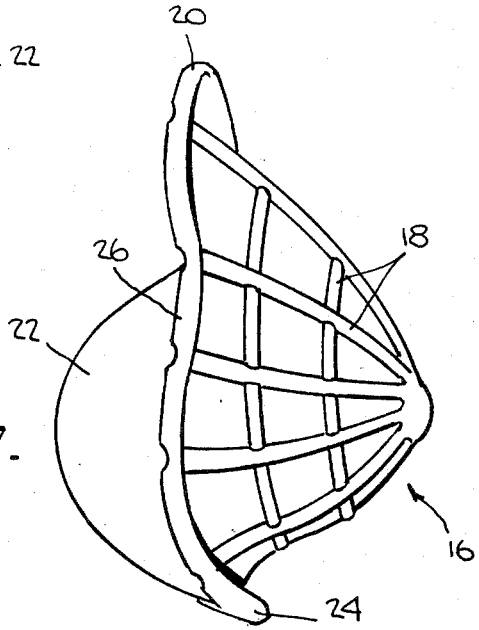
Fig. 7.

THORAX PROTECTOR

BACKGROUND OF THE INVENTION

1. Field of the Invention

This invention relates to thorax protectors in general and more particularly to a thorax protector with a specifically considered anatomical shape that distributes the force of a blow directed at the protector along the lines of support of the rib cage rather than on the soft mammary tissue.

2. Description of the Prior Art

Chest protectors or thorax protectors are known in the art. For example, U.S. Pat. No. 2,468,841 discloses a chest protector constructed of stuffed or padded fabric. This device, however, fails to provide support for the breasts and merely cushions blows on the mammary tissue.

U.S. Pat. Nos. 3,176,686 and 3,473,739 disclose chest protectors constructed of rigid, shock absorbent material. These devices, however, are conical in shape and fail to prevent the force of blows directed at these protectors from being distributed on the mammary tissue.

These prior art devices fail to provide protection from incidences of breast trauma which have been found to cause the onset of cancer. This is a particularly critical consideration for women involved with military or police forces or participating in contact sports.

SUMMARY OF THE INVENTION

It is therefore an object of the present invention to overcome the aforementioned disadvantages of prior art devices and provide a rigid thorax protector with an optimally designed configuration that causes the force from blows directed at the protector to be distributed along the lines of support of the rib cage.

It is a further object of the invention to provide a thorax protector that acknowledges the variations in size and shape of the right and left breast areas by providing a full range of protector sizes for each area not dependent on the other breast area's size.

These and other objects of the present invention are achieved in a thorax protector which is comprised of a rigid cup, which is anatomically contoured to fit over a wearer's breast. The cup is designed with a flange that is anatomically contoured to follow the thoracic curve so as to permit distribution of forces directed at the protector along the lines of support of the rib cage of the wearer.

These and other objects of the present invention are further achieved in a brassiere for protecting the thorax which comprises a brassiere containing pockets wherein may be removeably inserted rigid cups, each of which is anatomically contoured to fit over a wearer's breast. The cup is designed with a flange that is anatomically contoured to follow the thoracic curve so as to permit distribution of forces directed at the cup along the lines of support of the rib cage of the wearer.

These and other novel features and advantages of the invention will be described in greater detail in the following detailed description.

BRIEF DESCRIPTION OF THE DRAWINGS

In the drawings, wherein similar reference numerals denote similar elements throughout the several views thereof:

FIG. 1 is a perspective view of a thorax protector constructed according to the present invention;

FIG. 2 is a cross sectional view of the thorax protector, taken along section 2—2 of FIG. 1;

FIG. 3 is an exploded view of the thorax protector, showing the rigid cup and inner liner;

FIG. 4 is a front view of the left inner liner showing the configuration of the thorax protector;

FIG. 5 is a top view of the left inner liner showing the configuration of the thorax protector;

FIG. 6 is a side view of the left inner liner, observing the portion of the flange that crosses the pectoral muscle of the wearer, showing the configuration of the thorax protector;

FIG. 7 is a side view of the left inner liner, observing the portion of the flange that runs parallel to the sternum, showing the configuration of the thorax protector;

DETAILED DESCRIPTION

Figure 8:
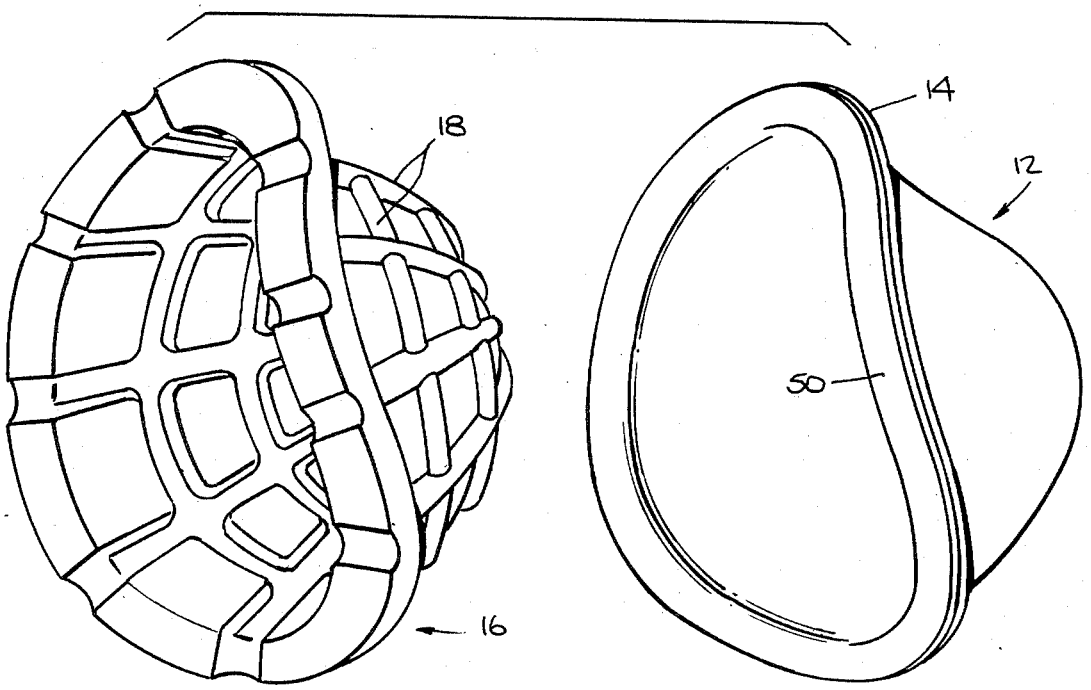
FIG. 8 is an exploded view of the thorax protector, showing the rigid cup with foam cushion and the inner liner.

Referring now to the drawings, and in particular to FIGS. 1–3, there is shown the left side of a thorax protector, generated identified by reference numeral 10, which is optimally designed to protect the thorax from injury.

The thorax protector is comprised of a set of right and left sided molds that are both simple and inexpensive to produce. Both the right and left molds can be made in a full range of sizes, thereby providing for variations in size and shape between the right and left breast areas.

Each mold is comprised of a rigid cup 12 which is anatomically contoured to intimately fit over the corresponding breast. The rigid cup 12 can be constructed from any resilient, high impact absorbant material. The preferred embodiment of the present invention would comprise rigid cups 12 constructed from styrene plastic or acetyl butyrate vacuum packed plastic. Additionally, heavier gauge materials could be used to create stronger material and greater force attenuation.

As illustrated in FIGS. 2 and 3, each rigid cup 12 has a flange 14 anatomically contoured to follow the thoracic curve. The flange 14 permits forces directed at the thorax protector 10 to be dissipated along the rib cage, thereby preventing or lessening damage to the soft mammary tissue.

An inner liner 16 is positioned on the interior of the rigid cup 12. The inner liner 16 is held in place by pressure from the breast of the wearer or may be removably attached to the inside of the rigid cup 12 by means of a velcro cuff or other snap mechanism. As shown in FIG. 2, the inner liner 16 has the same configuration as the rigid cup 12. The edges of the inner liner 16, however, extend beyond the edges of the flange 14 to provide additional comfort and protection to the wearer of the thorax protector 10. The inner liner 16 contains ventilation ribs 18 which permit air to reach the skin covered by the thorax protector 10. In the preferred embodiment of this invention, the inner liner 16 is made of formed cotton or soft synthetic fiber.

The thorax protector 10 has a specifically considered anatomical shape for optimal function. This shape is based on human anatomy and location of muscles, ligaments, bones, glandular breast tissue, and the pathophysiology of chest and shoulder girdle wall movements and vulnerability. This shape shields the breast and glandular tissue from forceful injury or contact.

As shown in FIGS. 4–7, the flange 14, beginning at its apex 20 and moving to the lateral aspect, crosses the pectoral muscle diagonally at 22 and turns downward following the fifth rib, at 24, to the medial aspect. The flange 14 then turns upward parallel to the sternum at 26, crosses the fourth and third ribs and again reaches its apex 20.

Figure 9:
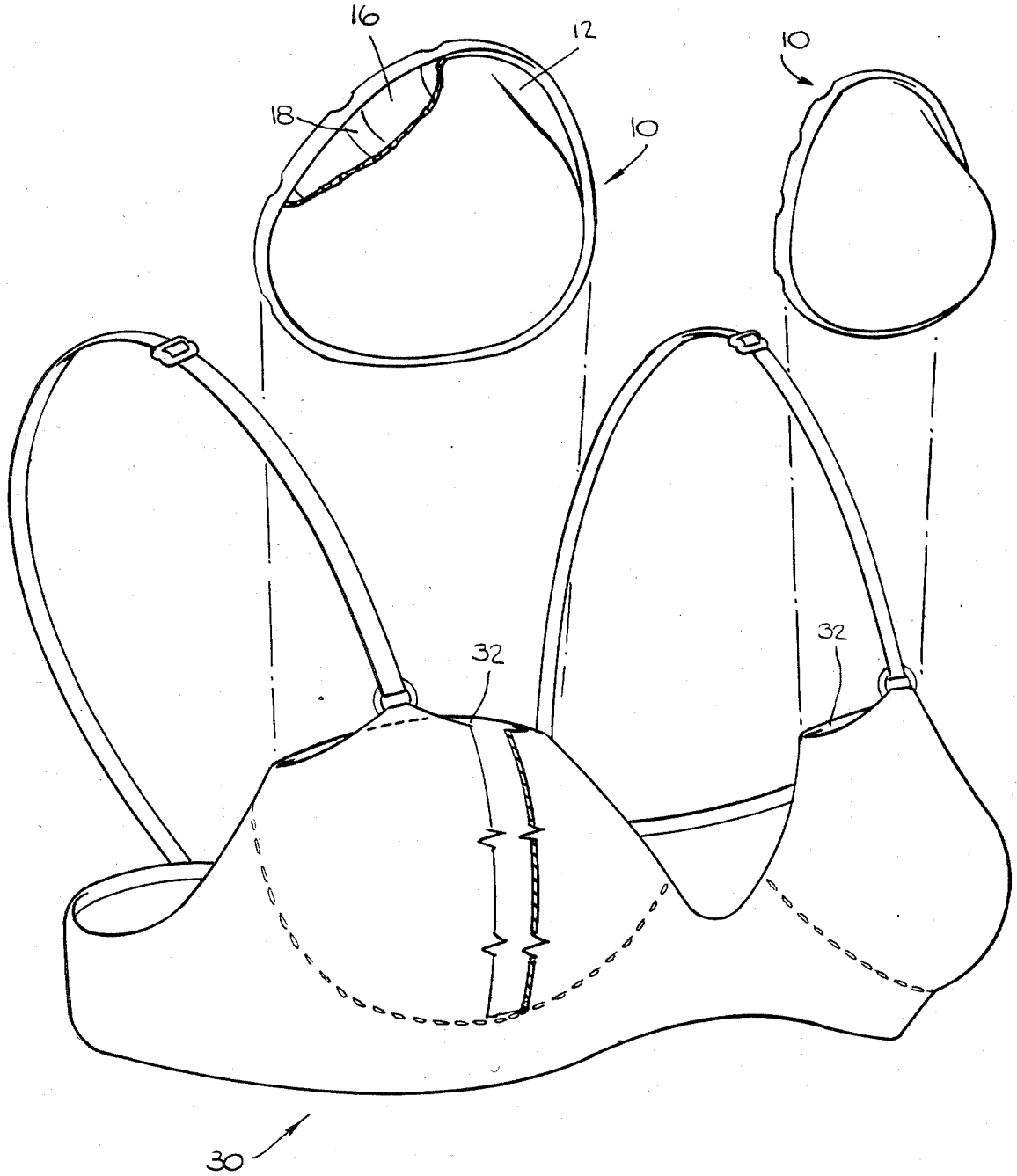
FIG. 9 is an exploded view of a brassiere with pocket, rigid cups and inner liner.

An alternative embodiment of the present invention is shown in FIG. 9. A brassiere 30 for protecting the thorax contains right and left pockets 32. Right and left rigid cups 12 and inner liners 16 may be removeably inserted into the corresponding pockets 32. The rigid cups 12 and inner liners 16 have flanges 14 and a configuration as previously described.

Figure 10:
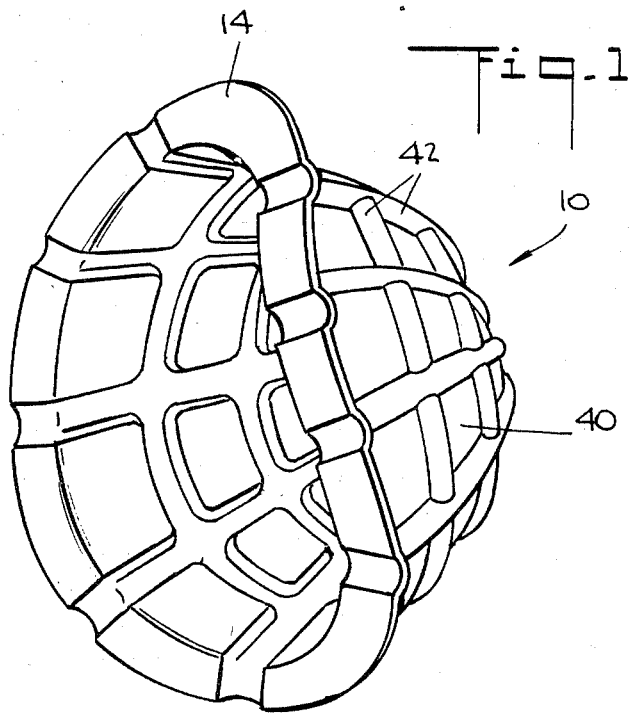
FIG. 10 is a perspective view of a thorax protector, showing a rigid cup with ventilation ribs.

Another alternative embodiment of the present invention is shown in FIG. 10 wherein the thorax protector 10 is comprised of a rigid cup 40. The rigid cup 40 has a flange 14 and configuration as the previously described rigid cups 12. Rigid cup 40 contains ventilation ribs 42 to permit air to reach the skin surface covered by the thorax protector 10.

As illustrated in FIG. 8, the rigid cups in all embodiments of the present invention may be laminated on the inside with a polyester foam cushion 50 for additional comfort and softness.

In addition, all embodiments of the present invention are sanitary and hygienic. The thorax protector 10 may be washed and reused or may be disposed and replaced.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A thorax protector which comprises:

rigid cup means anatomically contoured to fit over a corresponding breast of a wearer and having a flange means contoured to follow the curve of the thorax of said wearer for distributing forces directed at said thorax protector along the lines of support of the rib cage of said wearer, the contour of said rigid cup means being arranged so that said flange means, starting at the apex of said flange means and moving to the lateral aspect, crosses diagonally across the pectoral muscle of said wearer, turns downward following the fifth rib to the medial aspect and travels upward parallel to the sternum of said wearer, crossing the fourth and third rib, until said flange means again reaches its apex.

2. The thorax protector recited in claim 1, which also comprises inner liner means removeably attached to the inside of said rigid cup means, said inner liner means extending beyond the edges of said rigid cup means, and said inner liner means having multiple ventilation rib means.

3. The thorax protector recited in claim 2, wherein said ventilation rib means extend radially from the center of said inner liner means to the edges of said inner liner means and extend in concentric circular paths around said inner liner means at varying radii from the center of said inner liner means.

4. The thorax protector recited in claim 1, wherein the inner surface of said rigid cup means is laminated with a polyester foam cushion.

5. A brassiere for protecting the thorax which comprises:

a brassiere means containing pocket means;

rigid cup means removably insertable into said pocket means, said rigid cup means anatomically contoured to fit over a breast of a wearer and having a flange means contoured to follow the curve of the thorax of said wearer for distributing forces directed at said rigid cup means along the lines of support of the rib cage of said wearer, the contour of said rigid cup means being arranged so that said flange means, starting at the apex of said flange means and moving to the lateral aspect, crosses diagonally across the pectoral muscle of said wearer, turns downard following the fifth rib to the medial aspect and travels upward parallel to the sternum of said wearer, crossing the fourth and third rib, until said flange means again reaches its apex.

6. The brassiere for protecting the thorax as recited in claim 5, which also comprises inner liner means removeably attached to the inside of said rigid cup means, said inner liner means extending beyond the edges of said rigid cup means.

7. The brassiere for protecting the thorax as recited in claim 5, wherein the inner surface of said rigid cup means is laminated with a polyester foam cushion.

8. A thorax protector which comprises a right rigid cup means and left rigid cup means, each of said rigid cup means anatomically contoured to fit over the corresponding breast of a wearer and having flange means contoured to follow the curve of the thorax of said wearer for distributing forces directed at said thorax protector along the lines of support of the rib cage of said wearer, the contour of said rigid cup means being arranged so that said flange means, starting at the apex of said rigid cup means and moving to the lateral aspect, crosses diagonally across the pectoral muscle of said wearer, turns downward following the fifth rib to the medial aspect and travels upward parallel to the sternum of said wearer, crossing the fourth and third rib, until said flange means again reaches the apex.

9. A thorax protector which comprises a right rigid cup means and left rigid cup means, each of said rigid cup means anatomically contoured to fit over the corresponding breast of a wearer and having flange means contoured to follow the curve of the thorax of said wearer for distributing forces directed at said thorax protector along the lines of support of the rib cage of said wearer; and an inner liner means removably attached to the inside of each of said rigid cup means, said inner liner means extending beyond the edges of said rigid cup means, and each of said inner liner means having multiple ventilation rib means, said ventilation rib means extending radially from the center of said inner liner means to the edges of said inner liner means and extending in concentric circular paths around said inner liner means at varying radii from the center of said inner liner means.

10. The thorax protector recited in claim 8, wherein said rigid cup means have multiple ventilation rib means.

11. The thorax protector as recited in claim 8, wherein the insides of said rigid cup means are laminated with a polyester foam cushion.

12. A thorax protector which comprises a right rigid cup means and left rigid cup means, each of said rigid cup means anatomically contoured to fit over the corresponding breast of a wearer and having flange means contoured to follow the curve of the thorax of said wearer for distributing forces directed at said thorax protector along the lines of support of the rib cage of said wearer, said rigid cup means having multiple ventilation rib means, and said ventilation rib means extending radially from the center of said rigid cup means to the edges of said rigid cup means and extending in concentric circular paths around said rigid cup means at varying radii from the center of said rigid cup means.

* * * * *